US006612570B1

(12) United States Patent
Cox

(10) Patent No.: US 6,612,570 B1
(45) Date of Patent: Sep. 2, 2003

(54) HIGH SPEED STACKING APPARATUS

(76) Inventor: William A. Cox, 2387 Hidden Lake Ct., West Bloomfield, MI (US) 48324

( * ) Notice: Subject to any disclaimer, the term of this patent is extended or adjusted under 35 U.S.C. 154(b) by 0 days.

(21) Appl. No.: 09/583,846

(22) Filed: May 31, 2000

Related U.S. Application Data

(60) Provisional application No. 60/137,871, filed on Jun. 7, 1999.

(51) Int. Cl.[7] ..... B65H 29/00
(52) U.S. Cl. ..... 271/279; 271/303
(58) Field of Search ..... 271/270, 279, 271/285, 286, 303, 69, 256

(56) References Cited

U.S. PATENT DOCUMENTS

| | | | | |
|---|---|---|---|---|
| 4,027,580 A | | 6/1977 | Sundin | |
| 4,274,623 A | | 6/1981 | Reist et al. | |
| 4,310,152 A | | 1/1982 | Mitzel | |
| 4,361,318 A | | 11/1982 | Stobb | |
| 4,629,175 A | | 12/1986 | Fischer et al. | |
| 4,905,984 A | | 3/1990 | Haigh | |
| 5,390,911 A | | 2/1995 | Schmid | |
| 5,671,920 A | | 9/1997 | Acquaviva et al. | |
| 5,692,740 A | | 12/1997 | Holtje | |
| 5,695,185 A | | 12/1997 | Bell | |
| 6,062,556 A | * | 5/2000 | McCay | 271/256 X |
| 6,332,606 B1 | * | 12/2001 | Seki | 271/303 X |
| 6,338,479 B1 | * | 1/2002 | Van Der Werff et al. | 271/256 X |

* cited by examiner

*Primary Examiner*—David H. Bollinger
(74) *Attorney, Agent, or Firm*—Young & Basile

(57) ABSTRACT

A high speed material processing and stacking apparatus and method for overlapping and slowing the linear progression of material pieces in a continuous stream. The apparatus may include a doubler conveyor for separating material pieces in a stream permitting a substantial reduction in the linear velocity downstream. The apparatus and method may also include a discharge conveyor having a dam separator to introduce controlled separations to form discrete numbers of materials for further processing and shipping.

29 Claims, 9 Drawing Sheets

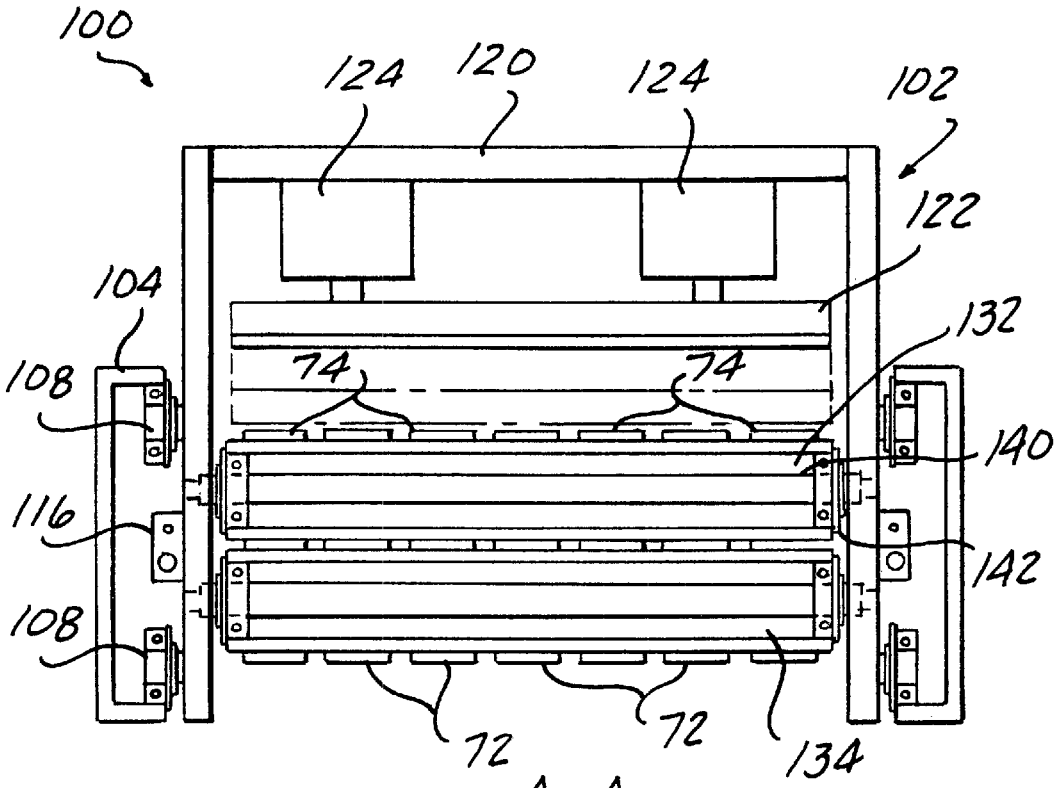
FIG. 6 A-A
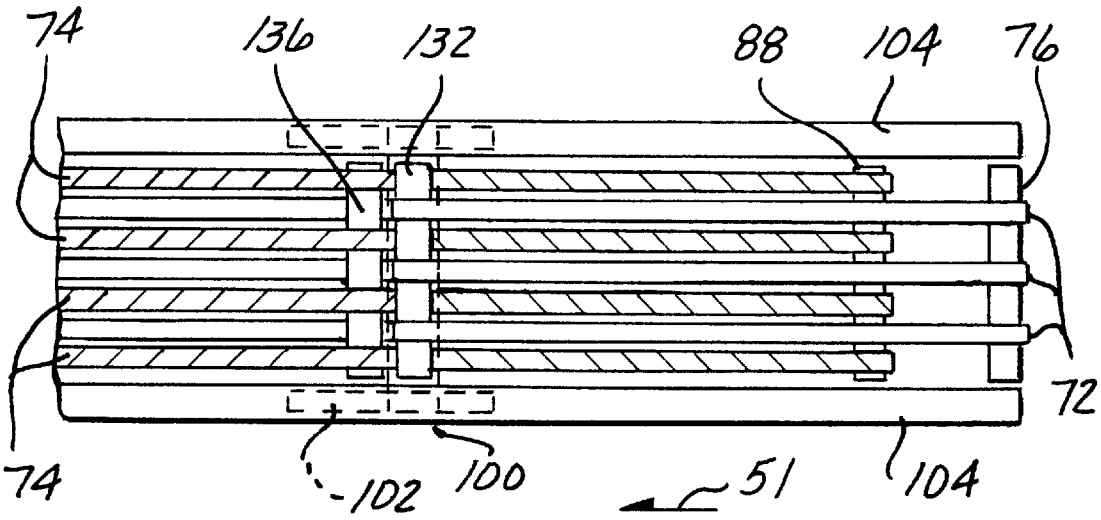
FIG. 7

HIGH SPEED STACKING APPARATUS

CROSS REFERENCE TO CO-PENDING APPLICATION

This application claims the benefit of the priority date of Provisional Application Ser. No. 60/137,871, filed Jun. 7, 1999 in the name of William A. Cox, the entire contents of which are incorporated herein by reference.

BACKGROUND OF THE INVENTION

The present invention relates to an apparatus and method for use in processing and stacking articles in a continuous stream of discrete individual material pieces. The invention is particularly useful in processing and stacking materials in a high speed material feed stream.

FIELD OF THE INVENTION

A typical manufacturing or printing process will include a sheet or continuous roll of raw material such as paper or cardboard that enters a press or punch having rotary cutting dies that sever the desired configuration from the sheet and forces the desired configurations out onto a conveyor system for additional processing such as sorting and stacking of the materials in discrete bundles for shipment to customers.

Numerous obstacles exist for processing, organizing and stacking material such as envelopes, documents, folding cartons, etc. especially at high material stream speeds exceeding eight-hundred (800) linear feet per minute. A significant challenge is to manage the linear speed or velocity of the material exiting the rotary dies. For efficiency purposes, the faster the rotary dies can process parts, the more product can be manufactured and shipped in a given period or shift.

Medium speed stacking systems exceeding five-hundred (500) or six-hundred (600) linear feet per minute become too fast for controlled manual or automated separation devices to separate and organize materials into discrete bundles or stacks of material for shipping. Prior art devices including receding pile and water fall stackers have been employed to shingle or overlap the cut or printed materials in the material stream to reduce the linear speed of the material downstream to manageable levels yet maintain a relatively high rotary die speed.

At high speeds, approaching and exceeding one-thousand (1000) linear feet per minute, a significant challenge beyond slowing the material stream velocity is to introduce controlled gaps or separations between discrete quantities of materials so accurate grouping and stacking of the quantities can be achieved. At such speeds, prior art devices such as starwheels, fanwheels and disk devices have been employed. Such devices typically required the materials to be timed from discharge of an upstream device in order for the articles to properly slide into defined regions in the wheel or disk which separate the articles without a need for shingling. Such prior devices suffer disadvantages of complex timing systems, the need to strip or remove the product from the wheel, and require the wheels or other processing devices to be specific to the product size or configuration. These requirements increase the complexity of the systems and significantly reduce adaptability of the devices to accommodate different materials, sizes and configurations. These disadvantages have adversely affected part quality, rate of production and process change-over time.

Prior art devices employing shingled material equally suffered disadvantages of complex mechanical separation devices such as swords and receding pile tables to introduce separations in the shingled stream to organize and sort discrete quantities for bundling and shipping. Such devices were typically complex and were specific to part configuration thereby decreasing efficiency both during production and during process change over to different materials, configurations and sizes.

Consequently, it would be desirable to provide an apparatus and method improving the disadvantageous conditions in the prior processing devices and methods that maintain product quality, are more efficient, less complex and easily adaptable to a change in material size and configuration.

SUMMARY OF THE INVENTION

The inventive apparatus includes a shingle wheel having a drum and a control belt defining a path of travel along a portion of the drum. Material in the stream is frictionally engaged between the rotating drum and belt along the path of travel to effectively shingle or overlap the material and reduce the linear velocity of the stream, hereinafter referred to as the shingle path portion or shingle path of travel of the material stream. In a preferred aspect, the control belt rotates relative to the drum and includes a tensioning member that automatically adjusts the tension in the control belt to adjust the radial distance or gap between the drum and belt to accommodate the passage of material along the shingle path of travel.

The invention also includes an apparatus and method for introducing separations between material in the stream and reducing the linear velocity of the stream. In a preferred aspect, a doubler conveyor receives the material stream and includes a pivoting material guide and two diverging conveyors forming two alternate paths of travel for the material in the stream. One of the alternate paths is longer than the other and on convergence of the alternate paths at the outlet end of the doubler conveyor, the diverted materials are placed on top of one another providing controlled separation between successive materials permitting a significant decrease in material stream velocity downstream without compressing the material pieces against one another in the stream.

The invention further includes an apparatus and method for introducing separations between materials in the stream through a discharge conveyor defining a discharge path of travel. In a preferred aspect, the discharge conveyors include two adjacent conveyors having a dam separator coupled to the discharge conveyors that selectively prevents passage of materials relative to the dam and first discharge conveyor. The dam is selectively moveable along the discharge path of travel thereby extending and decreasing the length of adjacent discharge conveyors along the discharge path allowing material to be run out from the second conveyor to introduce a separation without stopping or compressing the material pieces in the continuing stream.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 6 is a sectional view A—A of the dam separator shown in FIG. 5;

FIG. 7 is a partially cut away top view of the discharge conveyor showing the dam separator;

DESCRIPTION OF THE PREFERRED EMBODIMENT

Figure 1:
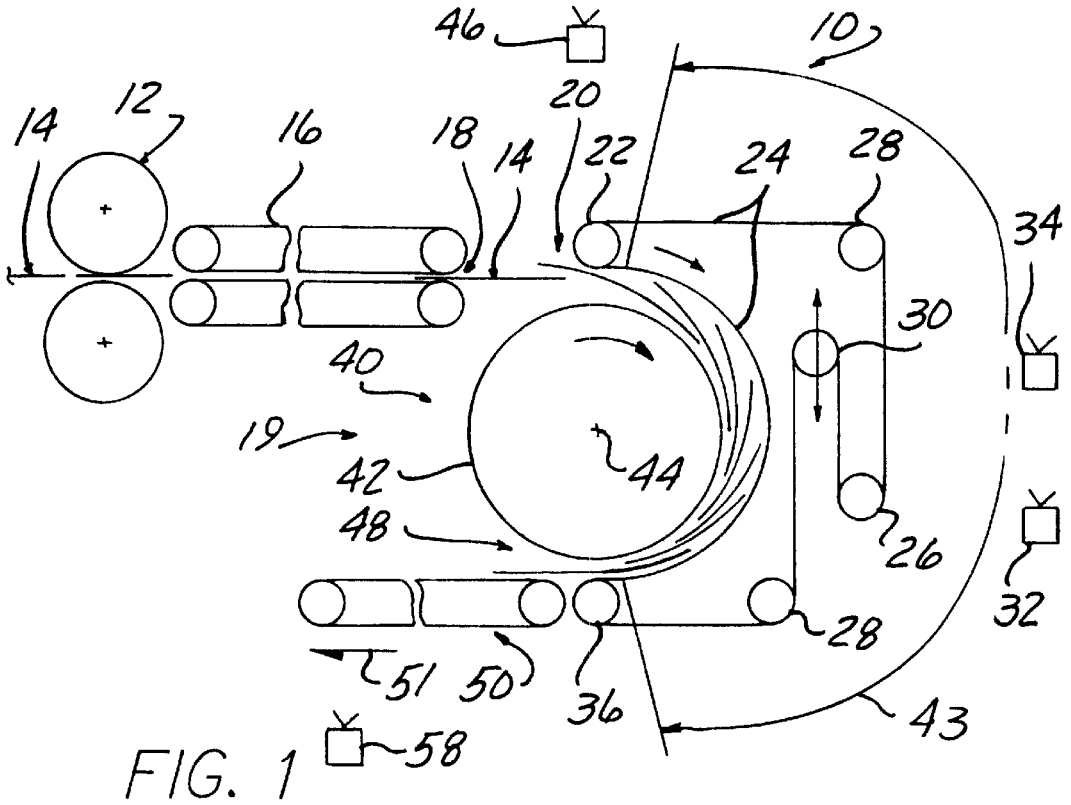
FIG. 1 is a side view of the material stream processor showing the shingle wheel.

Referring to FIG. 1, a high speed material stream processing and stacking apparatus 10 is illustrated. Apparatus 10 includes a set of rotary dies 12, for processing for example, die cutting, a material 14 in a substantially continuous material feed stream. Material 14 may consist of many types of material including paper, cardboard, folded cartons and other relatively thin and flat materials known by those skilled in the art. The individual, discrete material pieces exit rotary dies 12 in a generally end to end relationship with one another and are preferably engaged by and between take away conveyor belts 16. Take away belts 16 translate the continuous stream of materials 14 along a first path of travel at a take away discharge end 18. Throughout this disclosure, references made to conveyors illustrated and described as continuous, rotatable belts may, as understood by those skilled in the art, include other material handling devices such as a plurality of sequential elongate rollers. It is understood that depending on the material and velocity of the material stream, a single belt 16 could be used with the material resting on the upper surface.

The present invention provides a shingle wheel 19 including a drum 40 having an exterior periphery surface 42 radially distant from a longitudinal axis of rotation 44. Shingle wheel 19 includes means for driving drum 40 in rotation about the axis 44 by conventional means such as a variable speed motor, not shown, providing a substantially constant speed of angular rotation. In a preferred aspect, the speed of angular rotation forms a tangential velocity at drum periphery 42 which is slower than the linear velocity of material 14 traveling along take away belts 16 . Shingle wheel 19 preferably includes a control belt 24 rollingly engaged with several rollers including a control belt drive roller 26, substantially fixed guide rollers 28 and a tensioning guide member 30. The control belt 24 further includes a preferably fixed inlet roller 22 radially spaced from drum periphery 42 positioned proximate to a shingle wheel inlet 20. The control belt 24 further includes a discharge roller 36 which is preferably biased into contact with the drum periphery 42 but allowing passage of material 14 at a shingle wheel outlet 48.

As shown in FIG. 1, due to the placement of inlet 22 and outlet 36 guide rollers, control belt 24 is biased toward contacting a portion of drum periphery 42 along a shingle path of travel 43 as shown in FIG. 1. In an initial startup position when no material pieces 14 are provided along the first path of travel, control belt 24 is in direct contact with drum periphery 42 and no radial distance or gap between drum periphery 42 and belt 24 is observed along the shingle path of travel 43. In a preferred aspect, shingle path 43 is over a portion of drum periphery 42 as shown in FIG. 1, and more preferably, less than 180° of drum periphery 42. It is understood by those skilled in the art that the shingle path of travel 43 may be any portion of drum periphery 42 suitable to a particular application of material 14 to processed.

As shown in FIG. 1, material pieces 14 are partially exposed while still in contact with take away belt 16 as the leading or downstream edge of material 14 passes through the shingle wheel intake 20. Just prior to complete release of material 14 from take away belts 16, the leading edge of material 14 contacts control belt 24 or preferably, the trailing edge of a prior piece of material already positioned in the shingle wheel path of travel as shown in FIG. 1. Where desired for a subsequent piece of material to pass below or underneath the prior piece at the shingle wheel inlet 20, as shown in FIG. 1, conventional devices may be used such as vacuum assist mechanisms. Material 14 contacts and is frictionally engaged between the control belt 24, or a prior piece of material and the drum periphery 42 and is drawn into the shingle path of travel 43 through rotation of drum 40 and belt 24.

In a preferred aspect, tensioning member 30 is movable along a linear path of travel and functions to either take up slack in control belt 24, thereby decreasing the radial distance between drum periphery 42 and control belt 24 along the shingle path of travel 43, or increase the length of control belt 24 causing a radial gap to form or increase between drum periphery 42 and control belt 24 along the shingle path of travel 43. This radial gap or distance permits a stream of material 14 to frictionally pass along the shingle path of travel 43 between the drum periphery 42 and control belt 24 in an overlapped fashion providing a controlled, shingled stream of material 14 to exit shingle wheel outlet 48. The overlap or shingling of material 14 along shingle path 43 reduces the tangential linear velocity or progression of material 14 about drum periphery 42. In a preferred aspect, tensioning member 30 automatically adjusts the tension of control belt 24 and thereby the radial distance between drum periphery 42 and control belt 24 to accommodate the passage of materials 14 along the shingle path of travel 43. Movement of tensioning member 30 may be achieved through conventional means such as pneumatic or hydraulic cylinders, springs and weights. This dynamic adjustability provides system flexibility and reduces jamming of materials 14 during the shingling process thereby reducing down time and maintaining product quality. In a preferred aspect, control belt 24 further includes a position measuring device 34 which measures and monitors the linear position of tensioning member 30 along the linear path of travel as shown in FIG. 1.

In a preferred aspect, drum 40 is rotationally driven and monitored by a drum drive and controller 46 as described. Control belt 24 includes means for driving rotation of control belt 24 through rotation of drive roller 26. Rotation of drive roller 26, and control belt 24 may be by conventional means such as a variable speed motor, not shown, providing a substantially constant speed of angular rotation. Control belt 24 is controlled and monitored by a control belt controller 32. In a preferred aspect, the tangential velocity of control belt 24 through the shingle path of travel 43 is greater than the tangential velocity of drum periphery 42.

As shown in FIG. 1, apparatus 10 preferably includes a discharge conveyor 50 in material stream communication with shingle path of travel 43 proximate the shingle wheel outlet 48. Discharge conveyor 50 defines a discharge path of travel 51 for material 14 traveling to other work stations for further processing or to a shipping area. Discharge conveyor 50 preferably includes a continuous, rotatable belt driven and controlled by a discharge conveyor drive and controller 58. It is contemplated that a central control unit, not shown, is electronically connected to the drive and controllers to monitor and coordinate the functions of the shingling wheel, control belt 24 and discharge conveyor 50.

Figure 2:
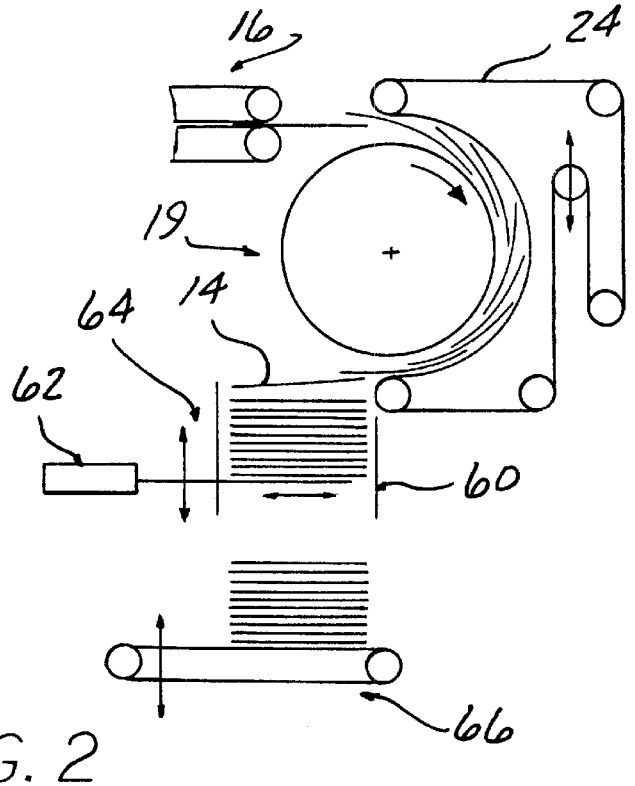
FIG. 2 is a partial side view of the material stream processor showing the shingling wheel as shown in FIG. 1 with optional downstream stacking or palleting.

In an alternate aspect shown in FIG. 2, shingle wheel 19 may discharge material 14 from shingle travel path 43 directly into a conventional stacking system including a stacking guide 60 used in conjunction with support swords 62 which slide in and out of stacking guide 60. When engaged, sword 62 supports discharge material 14 from shingle wheel 19 and is used in conjunction with joggers 64, not shown, to properly align the discharge material 14 in the transverse direction. After stacking the desired amount of material 14 in the stacking guide 60, sword 62 is quickly removed lowering the desired quantity to a secondary conveyor 66 which may transport the desired stack for additional processing or to a shipping location.

Figure 3:
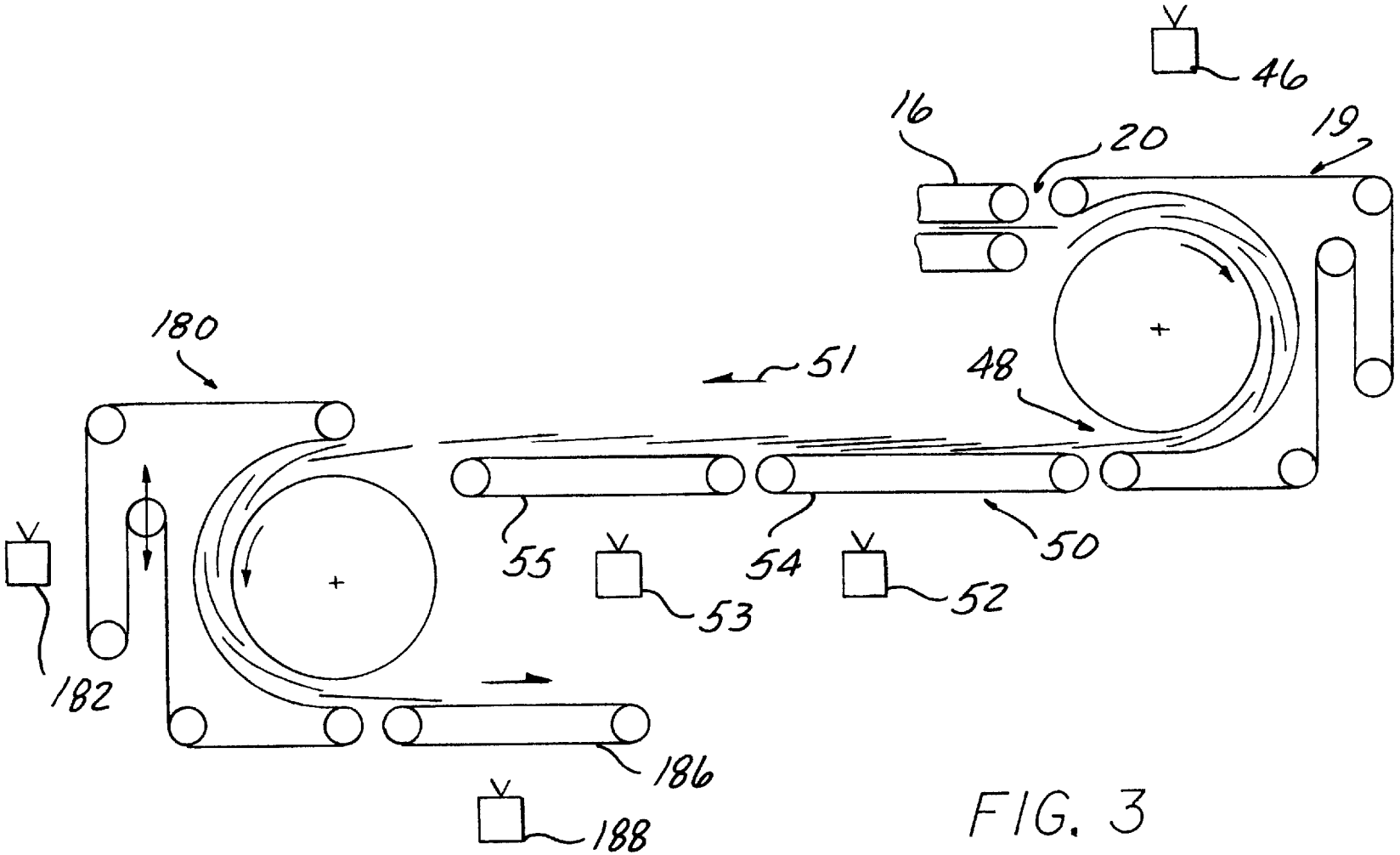
FIG. 3 is a partial side view of the material stream processor and stacker as shown in FIG. 1 with optional downstream second material processor and stacker.

Referring now to FIG. 3, in an alternate aspect of the invention, a second shingle wheel 180 is used in material stream communication with the discharge path of travel 51 as shown. Second shingle wheel 180 has a similar control belt and shingle path of travel and further reduces the linear velocity of material stream 14 while turning the material 14 upright again revealing the surface of the material 14 as first exited from the rotary dies 12. Second shingle wheel 180 preferably discharges material 14 onto a continuous, rotating shipping conveyor 186 driven and controlled by a shipping conveyor controller 188. In an alternate aspect, a stacking guide 60, as shown in FIG. 2, could equally be employed as understood by those skilled in the art.

As also shown in FIG. 3, in an alternate aspect, the first and second shingle wheels 19 and 180, respectively could be separated by a discharge conveyor 50 employing a first discharge conveyor 54 in communication with the shingle path of travel 43 and also a second discharge conveyor 55 in communication with the first discharge conveyor along the discharge path of travel 51 as shown. Preferably, the first conveyor 54 and second discharge conveyor 55 are continuous, rotatable drive belts driven by conventional means such as variable speed motors, not shown, which provide a substantially constant angular speed of rotation. First and second conveyors 54, 55 respectively are controlled by a first discharge conveyor controller 52 and a second discharge conveyor controller 53 as shown. The use and control of two discharge conveyors can eliminate the need for the conventional stacking system 60 as shown in FIG. 2 to introduce selective separations or gaps between a selected number of materials 14 so the discrete number can be off loaded and, for example, be bound or boxed for shipping.

Figure 4:
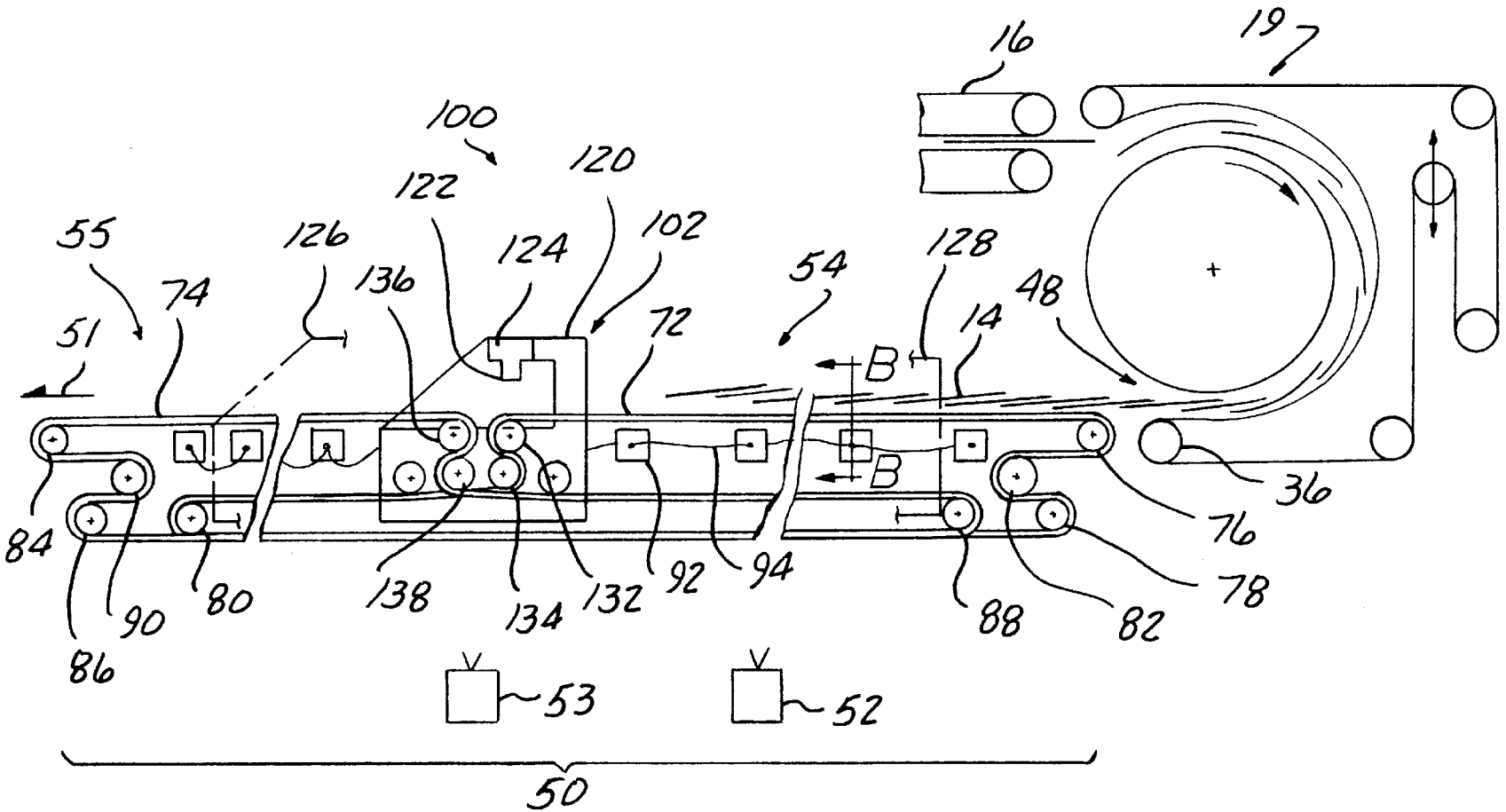
FIG. 4 is a partial side view of the material stream processor showing a preferred discharge conveyor and dam separator.

Referring to FIGS. 4 through 7, a preferred apparatus and method for introducing a separation in the stream of material pieces 14 is disclosed. Discharge conveyor 50 includes a first discharge conveyor 54 in material stream communication with the shingle path of travel 43 and a second discharge conveyor 55 downstream and in material stream communication with the first discharge conveyor 54. First discharge conveyor 54 and second discharge conveyor 55 include a first discharge belt 72 and a second discharge belt 74 respectively. First discharge conveyor 54 includes an inlet roller 76 proximate the shingling wheel discharge roller 36 as shown in FIG. 4. First discharge conveyor 54 further includes a take up roller guide 78, a limit roller guide 80 and a drive roller 82 all rollingly engaged with first discharge belt 72.

Second discharge conveyor 55 preferably includes an outlet roller guide 84, second take up roller 86, a second limit roller 88 and second drive roller 90 all rollingly engaged with second discharge conveyor belt 74. As shown in FIG. 7, discharge conveyor 50 preferably includes a plurality of first and second discharge conveyor belts 72 and 74 offset from one another as shown. First and second discharge conveyors 54, 55 respectively are driven by conventional means and controlled by first and second control units 52, 53 respectively as described.

Figure 5:
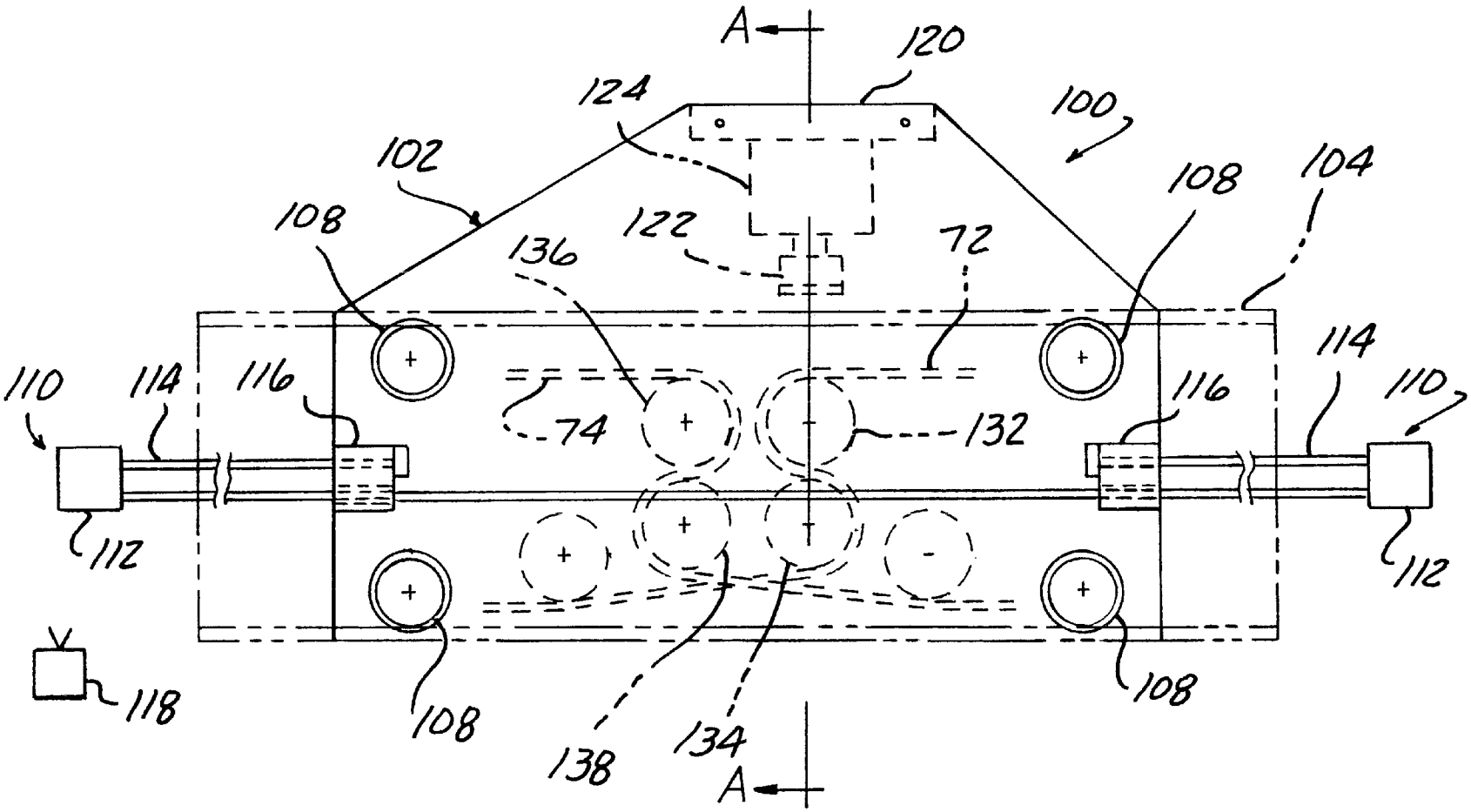
FIG. 5 is an enlarged side view of the dam separator in FIG. 4.

Referring to FIGS. 4 through 7, discharge conveyor 50 preferably includes a dam separator 100 including a carriage 102. Carriage 102 preferably includes a first upper conveyor guide 132 rollingly engaged with first discharge conveyor belt 72 and an opposing second upper carriage guide 136 rollingly engaged with the second discharge conveyor belt 74 as best seen in FIGS. 4 and 5.

Carriage 100 in the preferred configuration includes first and second lower carriage guides 134, 138 respectively rollingly engaged with the first discharge conveyor belt 72 and second discharge conveyor belt 74. As best seen in FIGS. 5 and 6, the preferred guides 132, 134, 136 and 138 are rotatably mounted to carriage 102 through coupling of, for example, a hexagonal shaped shaft 140 passing through the rotational axis of the guides and preferably including a pair of roller bearings 142 coupled to the hex shafts 140 permitting free rotation of guides 132, 134, 136, and 138 about hex shafts 140. It is understood that different shapes or configurations of shafts may be used other than hexagonal to achieve the described objectives.

As best seen in FIGS. 5 and 6 carriage 102 is preferably supported by elongate rails 104 positioned parallel to discharge path of travel 51. Carriage 102 preferably includes eight roller bearing guides 108 connected to carriage 102. Roller bearing guides 108 are supported by and in rolling engagement with rails 104. Roller bearing guides 108 and rails 104 permit translation of dam separator 100 both upstream and downstream along discharge path of travel 51 as best seen in FIGS. 4 and 5. As carriage 102 translates toward a downstream position 126 (toward first limit guide 80, shown in phantom) the discharge path of travel along first conveyor belt 72 increases while the discharge path of travel 51 along second discharge belt 74 decreases. The reverse occurs when carriage 102 translates upstream toward an upstream position 128 adjacent second limit guide 88. Once the first and second take up rollers 78 and 86 are properly adjusted for the particular application, proper tension of discharge belts 72 and 74 are achieved and the dam separator 100 permits translation of carriage guide 102 without need for continuously adjusting devices.

Carriage 102 preferably includes a blocker member 122 spanning the material stream 14 on the discharge path of travel 51 as best seen in FIG. 6. Blocker member 122 is preferably coupled to carriage cross member 120 through pneumatic cylinders 124 providing vertical movement of blocking member 122 to selectively clamp and prevent passage of material 14 relative to blocker member 122 and exiting first discharge conveyor 54. Although pneumatic cylinders 124 are disclosed, other devices may be employed such as hydraulics, motors and gears and other suitable mechanisms known by those skilled in the art.

Dam separator 100 further includes means for translating carriage 102 upstream and downstream along discharge path of travel 51. At least one motorized winch 110 and a cable 114 may be employed to translate carriage 102. As shown in FIG. 5, two motorized winches 110 and cables 114 are used. The motors 110 are mounted to rails 104 upstream and downstream of first and second limit rollers 80, 88 respectively shown in FIG. 4. Each motor 110 engages an elongate cable 114 having opposing ends respectively attached to a mounting plate 116. Mounting plates 116 are attached to carriage 102 as shown in FIG. 5. In operation, either the upstream or downstream motor 110 will activate and pull carriage 102 in the desired direction along discharge path 51 at substantially the same linear velocity as first discharge conveyor belt 72. Activation and coordination of motors 110 are provided by controller 118. Controller 118 can be electronically connected to a central control unit, not shown, to monitor and coordinate the various drive and control units. For exemplary purposes, an Allen Bradley PLC with a touch screen interface can be used for logic control.

Figure 9:
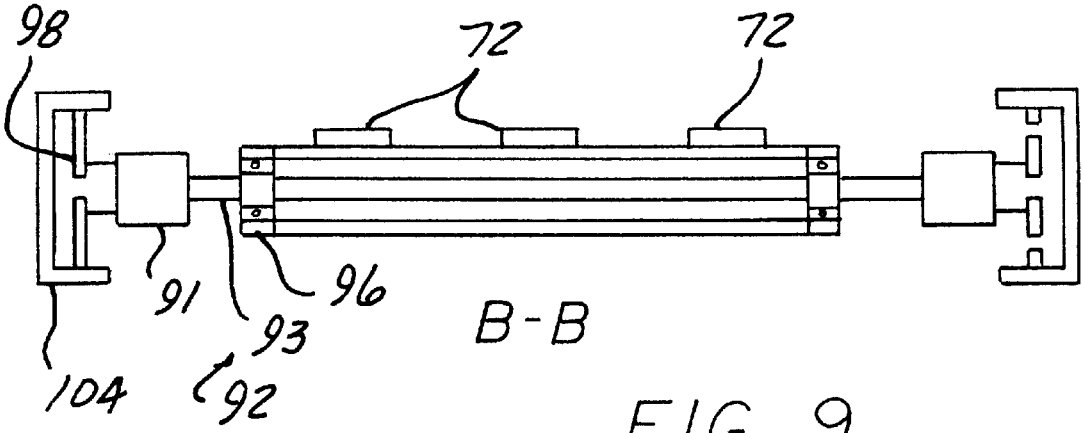
FIG. 9 is a sectional view B—B of the discharge conveyor showing a belt support guide shown in FIG. 4.

Referring to FIGS. 4 and 9, dam separator 100 preferably includes belt support roller guides 92 as best seen in FIG. 9. Belt supports 92 preferably include a hex-shaped shaft 93 including support blocks 91 coupled to hex shaft 93. Support block 91 includes roller bearings 98 rollingly engaged and supported by rails 104. Support guides 92 further include roller bearings 96 coupled to the hex shaft 93 providing for ease of rotation of guides 92 supporting movement of first and second discharge conveyor belts 72, 74 respectively. Roller guides 92 are preferably interconnected to one another and to carriage 102 by ties 94 as best seen in FIG. 4.

As best seen in FIGS. 4 and 5, in a preferred method of operation, shingled material 14 exits shingle path of travel 43 onto first discharge conveyor 54. Dam separator 100 is in an upstream position 128 thereby decreasing the first discharge conveyor 54 and extending second discharge conveyor along discharge path of travel 51. At this point, first and second discharge control belts 72, 74 respectively are operating at a first linear velocity substantially the same as the first tangential velocity of shingle wheel 19. When a gap is desired in the material stream 14, for example determined by a material sensor counting the material 14 passing it, blocker member 122 is lowered by pneumatic cylinders 124 to clamp a piece of material 14 between the blocker member 122 and first discharge belt 72. At approximately the same time, the linear velocity of second discharge conveyor 55 is increased and begins to quickly move or run out material 14 downstream of blocker member 122. In order to prevent compression of material stream 14 upstream of blocker member 122, carriage 102 simultaneously begins moving downstream by motors 110 at substantially the same linear velocity as the first discharge conveyor 54. Movement by carriage 102 downstream toward position 126 extends the length of belt 72 and decreases belt 74 along the discharge path of travel 51. By moving carriage 102 downstream at substantially the same linear velocity as first discharge belt 72, material stream 14 is not compressed and continues along discharge path 51. During continued progression of carriage 102 and material stream 14, second discharge belt 74 is operating at a higher linear velocity introducing and increasing a separation downstream of blocker member 122 allowing the material stream 14 exiting shingle wheel 19 to continue uninterrupted and substantially uncompressed.

When material 14 downstream has run out or has cleared second discharge conveyor 55, or achieved a desired separation, blocker member 122 is lifted and downstream movement of carriage 102 is halted. Simultaneously, the linear velocity of second discharge conveyor is reduced to the velocity of the first discharge conveyor 54. Subsequently, carriage 102 is moved back to the upstream position 128 by upstream motor 110 for another cycle.

Upon translation of carriage 102 along the discharge path of travel, support rollers 92 extend and, contract through rolling engagement along rails 104 while providing interim support for first 72 and second 74 discharge conveyor belts. Ties 94 between support rollers 92 provide for an accordion-like movement. Ties 94 are preferably constructed of flexible cable or rope although other materials and devices known to those skilled in the art may be used.

Figure 8:
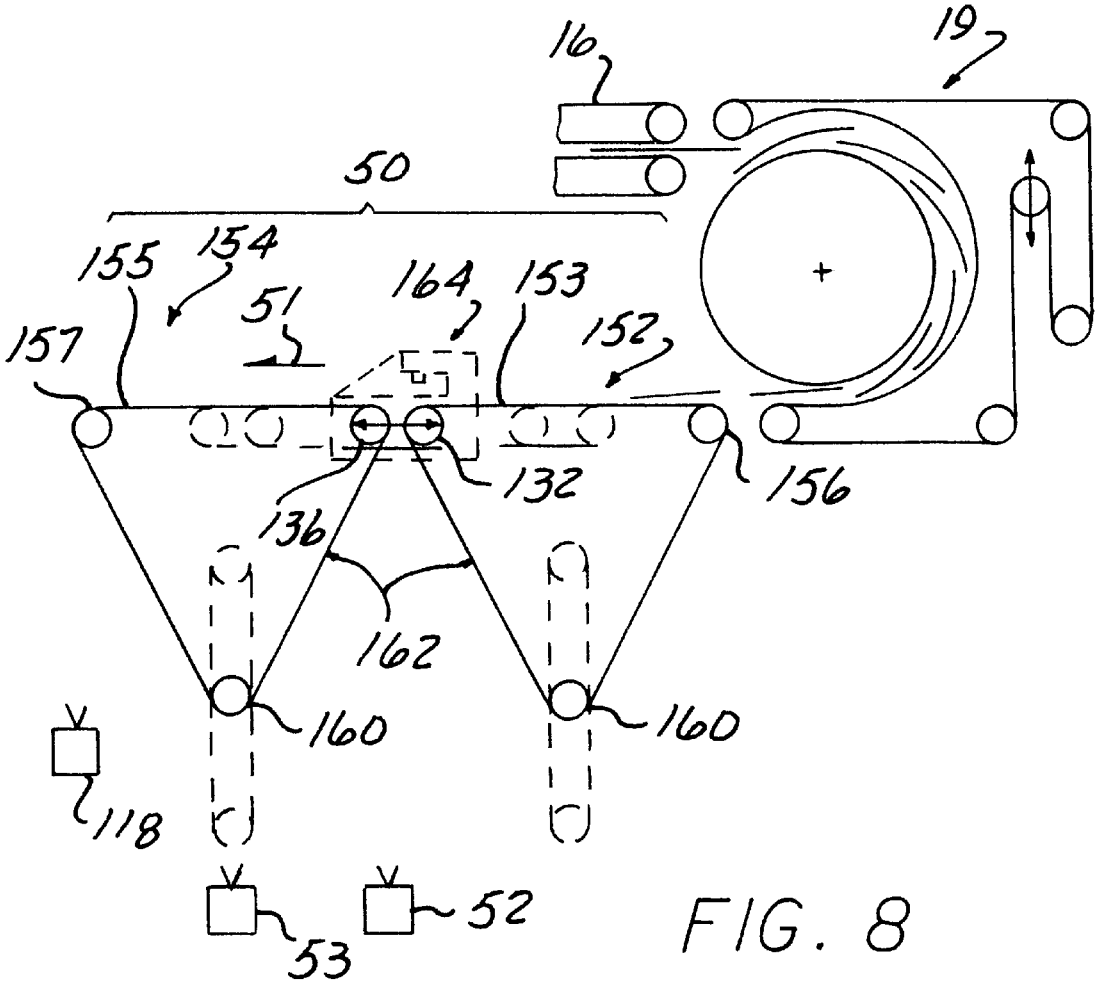
FIG. 8 is a partial side view of the material stream processor showing an alternate discharge conveyor and dam separator.

Referring to FIG. 8, the discharge conveyor 50 includes a first discharge conveyor 152 and a second discharge conveyor 154 in material stream communication with one another and downstream of shingle path 43. An alternate configuration of dam separator 164 includes a single pair of upper conveyor guides 132 in rolling engagement with first discharge conveyor belt 153 and second upper guide 136 in rolling engagement with the second discharge conveyor belt 155. The first discharge conveyor 152 and second discharge conveyor 154 each further include a take up pulley 160 for maintaining the tension in the discharge conveyor belts 153 and 155 during translation of the dam separator 164 along the discharge path of travel 51 as shown in phantom. First discharge conveyor 152 can include an inlet guide 156 and the second discharge conveyor can include an outlet guide 157 as shown in FIG. 8. Alternate dam 164 is driven in a similar manner with motors 110 and controller 118 as previously described and shown with respect to FIGS. 4 and 5.

In operation, the dam separator 164, selectively translates along discharge path of travel 51 to extend or decrease the first and second discharge conveyors along the discharge path of travel 51. To accommodate for the extension and decrease of the first and second discharge conveyors 152, 154 respectively, take up pulleys 160, for example, translate along a linear path to accommodate the position of the separator dam 164 to adjust to the required length and maintain adequate tension in discharge conveyor belts 153, 155 accordingly.

Referring to FIG. 3, an apparatus and method are disclosed for introducing controlled separations in material stream 14 for use in separating the material stream 14 into discrete numbers for off loading and shipping desired quantities. In one configuration excluding a second shingle wheel 180, separations can be introduced by momentarily increasing the linear velocity of first and second discharge conveyors 54, 55 respectively above the first tangential velocity of shingle wheel 19. This introduces a brief separation in material stream 14 without compressing the material stream 14 along the discharge path 51. The linear velocity of first and second discharge conveyors 54, 55 respectively are quickly returned to the original velocity until the selected number of materials passes and another gap is desired. A sensor, not shown, can be employed along any of the paths of travel previously defined to count the number of materials and signal the described conveyor drivers and controllers 52, 53 to increase the velocities and introduce separations. Preferably, the sensor is located at the shingle wheel outlet 48.

In an alternate aspect, to increase the separation introduced at the first discharge conveyor 54, the tangential velocity of shingle wheel 19 could, along with the above described increase in conveyors 54, 55, simultaneously and momentarily decrease then be returned to its first or original tangential velocity.

A separation in material stream 14 can also be introduced at the inlet end 20 of shingle wheel 19 by simultaneously and momentarily increasing the velocities of shingle wheel 19, first and second discharge conveyors 54, 55 respectively and thereafter returning to the first or original velocities. It is understood by those skilled in the art that other combinations of coordinated actions of increasing and decreasing the velocities of shingle wheel 19 and first and second discharge conveyors 54, 55 respectively to obtain a controlled separation in material stream 14 are contemplated and not described.

Figure 10:
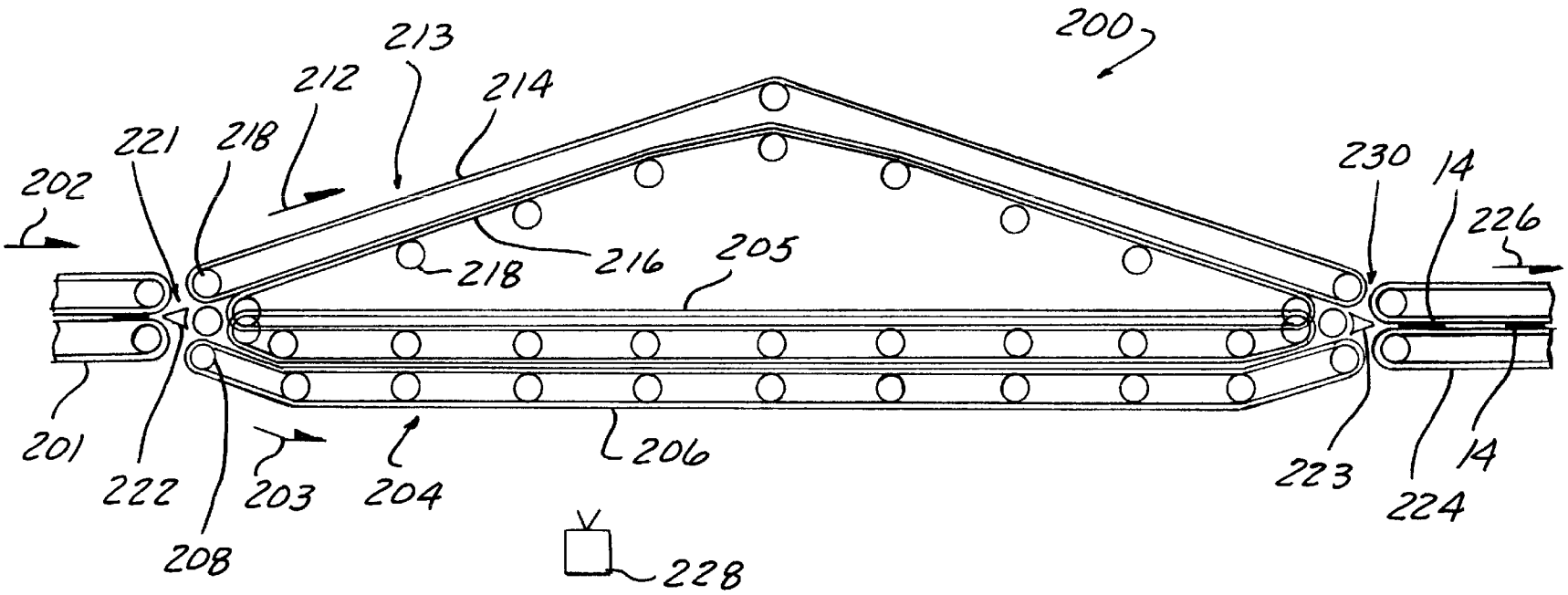
FIG. 10 is a side view of a doubler conveyor.
Figure 11:
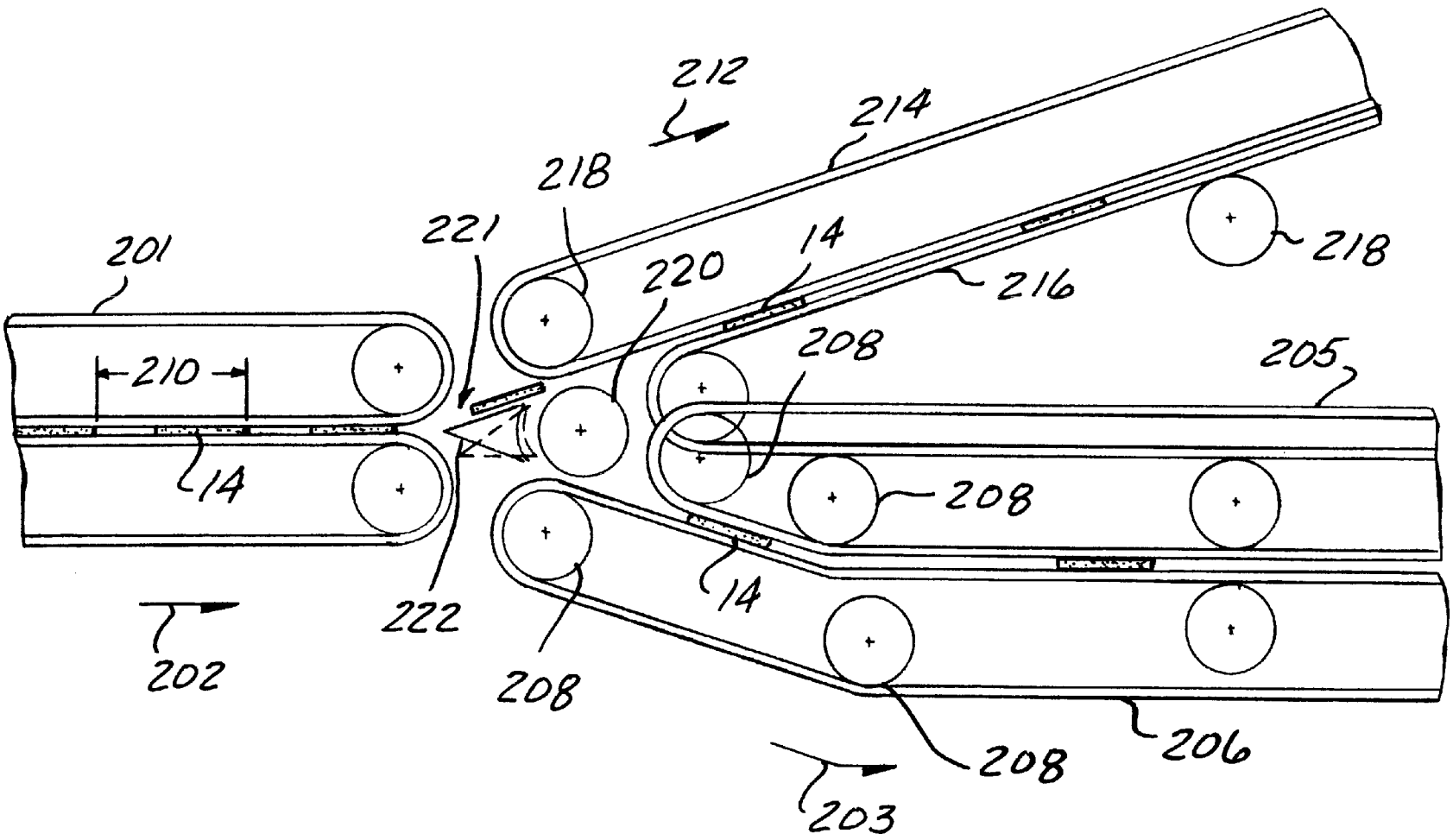
FIG. 11 is an enlarged side view of the doubler conveyor at the inlet end.
Figure 12:
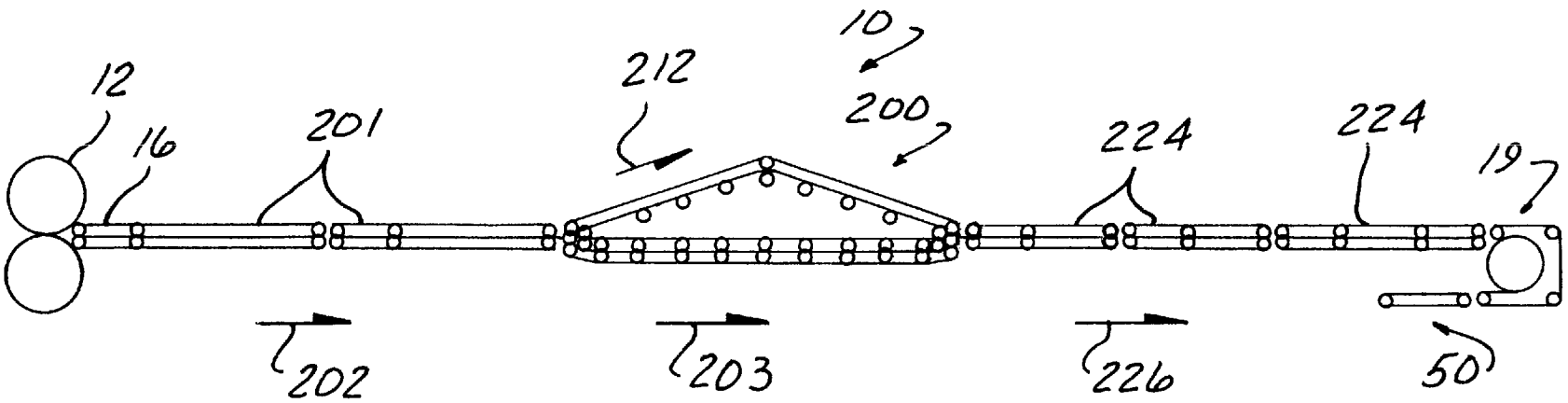
FIG. 12 is a side view of a preferred material processor.

Referring now to FIGS. 10 through 12, an apparatus and method for separating and reducing the linear velocity of a material stream is illustrated. As seen in FIGS. 10 and 11, a doubler conveyer 200 is shown. The doubler conveyor 200 is in material stream communication with a speed up conveyor 201 defining a first path of travel 202 typically providing a continuous, high speed material stream from rotary dies 12. As shown in FIG. 11, material stream 14 includes a pitch 210 defined as the linear distance between the leading or downstream edge of a material 14 to the leading edge of the immediately adjacent, upstream piece of material including any separation between them. Although shown in FIG. 11 as including a small gap or separation between materials 14, it is understood a larger separation or no separation at all may exist depending on the particular application.

Doubler conveyor 200 provides a second path of travel 203 preferably defined by a first doubler conveyor 204 having an upper conveyor belt 205 and a lower conveyor belt 206. Conveyor belts 205 and 206 are rollingly engaged with guide rollers 208 as shown in FIGS. 10 and 11. Doubler conveyor 200 defines a third path of travel 212 through a second doubler conveyor 213 having an upper conveyor belt 214 and a lower conveyor belt 216 in rolling engagement with guide rollers 218. As shown in FIGS. 10 and 11, the second path of travel 203 and third path of travel 212 diverge from one another proximate to the doubler conveyor inlet 221 and converge proximate to doubler outlet 230 as shown in FIG. 10. First and second doubler conveyors 204, 213 respectively are rotatably driven by conventional means, such as variable speed motors, not shown, which provide a substantially constant speed of angular rotation.

For exemplary purposes, as shown in FIGS. 10 and 11, both second and third paths of travel 203, 212 respectively diverge from one another and also from the first path of travel 202. Its understood that either the second or the third paths 203, 212 could substantially lie in the same linear direction as first path 202 allowing the other of the second and third paths of travel to diverge therefrom. Referring to FIG. 11, doubler conveyor 200 further includes means for directing material 14 along the second and third paths of travel 203, 212 respectively. Preferably, the means includes a material guide 222 pivotally attached to doubler conveyor 200. Material guide 222 selectively directs material 14 to either the second or third paths of travel 203, 212 respectively. Other diverting devices are contemplated such as flipper doors and others known by those skilled in the art. Doubler conveyor 200 preferably includes an idler roller 220 proximate to and downstream from material guide 222. Idler roller 220 assists in the progression of material 14 to the second 203 and third 212 paths of travel and to accommodate the preferred offset of belts 204, 216 as shown in FIG. 11.

Referring to FIG. 10, doubler conveyor 200 can include a doubler outlet guide 223 proximate to the doubler outlet end 230. Doubler conveyor 200 is in material stream communication with a fourth path of travel 226 defined by a speed reduction conveyor 224. Doubler conveyor 200 can also include a driver controller 228 for driving and controlling first doubler conveyor 204, second doubler conveyor 213, and doubler material guide 222 during operation of the apparatus.

The second path of travel along first doubler conveyor 204 includes a first length between the doubler conveyor inlet 221 and doubler outlet 203. The third path of travel along the second doubler conveyor 213 defines a second length between the doubler inlet 221 and doubler outlet 230. In a preferred aspect, the second length along the third path of travel is longer than the first length. More preferably, the second length is at least one material pitch 210 longer than the second path of travel 203.

As best seen in FIGS. 10 and 11, a continuous, high speed material stream 14 is provided along a first path of travel 202, typically from rotary dies 12. As material stream 14 approaches doubler conveyor 200, doubler material guide 222 is normally in an up position, shown in solid line in FIG. 11, preventing material 14 from entering the third path of travel 212 and directing material 14 to the second path of travel 203. In dynamic or midstream operation, doubler material guide 222 is pivotally controlled by driver controller 228 and alternates permitting material 14 to enter either the second or third path of travel 203, 212 respectively. Material guide 222 alternately directs every other piece of material 14 to the third path of travel 212 such that the first piece of material 14 is directed along the second path and the immediately subsequent piece of material 14 is directed to the third path of travel 212 and so on.

The first doubler conveyor 204 and second doubler conveyor 213 operate at substantially the same linear velocity for translating material 14 at the same linear velocities along the second and third paths of travel. The third path of travel is one material pitch 210 greater in length than the second path of travel. As the second and third path of travel converge proximate outlet end 230, material 14 traveling along the third path of travel has moved one material pitch 210 longer in length thereby delaying the material 14 along third path 212 from exiting at the doubler outlet 230. The second 203 and third 212 paths of travel converge at the doubler outlet 230 so that materials 14 are guided by the doubler outlet guide 223.

Due to the greater length of the third path of travel, preferably one material pitch 210, material 14 exiting the third path of travel will be placed directly on top of material 14 exiting the second path of travel 203. As shown in FIG. 10, two pieces of material 14, placed one directly on top of one another, exit doubler conveyor 200 at doubler outlet 230 and are directed to the fourth path of travel 226 for further processing. The doubler conveyor, by placing one material 14 on top of the other, increases the separation or gap between materials 14 to permit a substantial reduction in speed downstream without compressing materials 14 which reduces the likelihood of jamming of the materials and processing devices downstream. These benefits are achieved while maintaining the maximum speed of the rotary dies 12.

Although doubler conveyor 200 has been disclosed having a third path of travel one material pitch 210 greater in length than the second path 203, it is understood that longer or shorter distances may be employed depending on the material 14 itself or its configuration, or the application. For example, the third path of travel may be increased to three, or any odd number of material pitches 210 greater in length than the second path of travel 203 to achieve the desired overlap of materials 14 as described.

Doubler conveyor 200 by controlling what paths of travel material 14 travel, provides increased flexibility and adaptability. During relatively slow material stream operation, where a separation may not be required, material 14 may simply be directed along second path 203 without utilizing the third path 212. Change over to a high speed application could be easily accommodated by beginning to alternate material 14 along the second 203 and third paths 212 of travel to introduce the desired separations between materials 14.

Referring now to FIG. 12, the doubler conveyor 200, can be used as part of a method to separate material 14 in a high speed stream and reduce the linear velocity of a material stream 14 to assist in processing and stacking. As shown in FIG. 12, rotary dies 12 may provide a continuous, high speed stream of discrete, individual material pieces 14 into a first path of travel 202, on take away belts 16. Take away belts 16 can include multiple, laterally spaced belts to accommodate numerous materials placed in side by side orientation by the rotary dies 12 and can be skewed such that take away belts 16 may diverge from one another to separate materials 14 that can be nested after exit of the rotary dies 12. Once separated on take away belts 16, the materials travel along a substantially planar path downstream along the first path of travel 202. Material stream 14 travels at a high linear velocity along first path 202, for example, exceeding eight hundred (800) feet per minute, leaving little or no separation or gap between the materials 14 exiting the rotary dies 12. One or more speed increasing conveyors 201 are included downstream and in material stream communication with take away belts 16 as shown in FIG. 12. The additional linear velocity provided by the speed increasing conveyors 201 introduces a separation between material pieces 14. As shown in FIG. 12, a doubler conveyor 200 can be provided in material stream communication with the first path of travel 202 and speed increasing conveyors 201. Doubler conveyor 200 introduces an additional separation between materials 14 by directing a selected number of materials traveling along a third path of travel 212 on top of diverted materials traveling along the second path of travel 202 at the doubler outlet end 230. The method according to the present invention can include providing at least one speed reduction conveyor 224 in material stream communication with the doubler conveyor 200 defining a fourth path of travel 226. As shown in FIG. 12, for exemplary purposes only, three speed reduction conveyors 224 are employed.

The material stream 14 can be effectively separated by the speed increasing 201 and doubler conveyor 200 such that the linear velocity of material stream 14 may be substantially reduced without bunching or compressing materials 14 along the fourth path of travel 226. Material 14 can be translated for further processing, for example, as shown in FIG. 12, to a shingle wheel 19 and discharge conveyor 50 for further reduction in velocity and translation toward additional processing or shipping.

It is understood that, depending on the application, the shingle wheel 19, discharge dam separator 100 and doubler conveyor 200 can individually, or jointly be used together to satisfy the requirements of the specific application without deviating from the present invention as disclosed.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for separating materials in a continuous stream of discrete individual material pieces along a first path of travel, the apparatus comprising:

a doubler conveyor having an inlet end and an outlet end, the doubler conveyor having a first conveyor in communication with the stream of material pieces from the first path, the first conveyor defining a second path of travel having a first length, and a second conveyor in communication with the stream of material pieces from the first path, the second conveyor defining a third path of travel having a second length, the second and third paths of travel diverge proximate to the inlet end and converge proximate to the outlet end; and means for selectively diverting the material form the first path to the second and third paths of travel.

2. The apparatus of claim 1 wherein the means for selectively diverting the material further comprises:

a material guide positioned proximate to the doubler conveyor inlet end, the guide pivotally coupled to the doubler conveyor to selectively permit materials to enter the second and third paths of travel.

3. The apparatus of claim 2 wherein the means for selectively diverting further comprises an idler roller positioned proximate to the inlet end to guide material to the second and third paths of travel.

4. The apparatus of claiming 1 wherein the second length of the third path of travel is greater than the first length of the second path of travel.

5. The apparatus of claim 4 wherein the second length of the third path of travel is at least one pitch greater in length than the first length of the second path of travel.

6. The apparatus of claim 1 wherein each of the first and second doubler conveyors further comprises:

an upper conveyor belt and a lower substantially parallel conveyor belt, the upper and the lower belts frictionally engage the stream of material pieces traveling along the respective second and third paths of travel.

7. An apparatus for separating materials in a continuous stream of discrete individual material pieces along a first path of travel, the apparatus comprising:

a first discharge conveyor having a first continuous rotatable belt and a material inlet end and an outlet end along the discharge path of travel;

a second discharge conveyor downstream and in communication with the stream of material pieces from the first discharge conveyor having a second continuous rotatable belt and an inlet end and an outlet end, the inlet end of the second conveyor adjacent to the outlet end of the first discharge conveyor along the first path of travel;

a dam separator having a carriage spanning the stream of material pieces and a first upper guide and a second upper guide opposing and downstream from the first guide, the first upper guide in rolling engagement with the first conveyor belt proximate the outlet end, the second upper guide in rolling engagement with the second conveyor belt at the inlet end, the carriage having a moveable blocker member for selectively and intermittently preventing materials from passing the blocker member and the first discharge conveyor along the first path of travel; and means for translating the carriage along the first path of travel.

8. The apparatus of claim 7 wherein the means for translating the carriage further comprises:

at least one motor and a cable attached to the carriage, the cable rotatably engaged with the motor for selectively translating the carriage along the first path of travel.

9. The apparatus of claim 7 wherein the first discharge conveyor further comprises a substantially stationary inlet guide proximate the inlet end of the first conveyor and a first take up pulley engageable with the first discharge conveyor belt, and wherein the second discharge conveyor further comprises a substantially stationary outlet guide proximate the outlet end of the second conveyor and a second take up pulley engageable with the second conveyor belt, the first and second take up pulleys movable to maintain tension of the first and second conveyor belts during translation of the carriage along the discharge path of travel.

10. The apparatus of claim 7 wherein the first conveyor further comprises an inlet guide proximate the inlet end of the first conveyor and a limit guide downstream of the first upper carriage guide in rolling engagement with the first discharge conveyor belt and a lower carriage guide adjacent the first upper carriage guide in rolling engagement with the first conveyor belt, and wherein the second conveyor further comprises an outlet guide proximate the outlet end of the second conveyor and a second limit guide upstream of the second upper carriage guide in rolling engagement with the second discharge conveyor belt and a lower carriage guide adjacent the second upper carriage guide in rolling engagement with the second conveyor belt, the carriage selectively translating along the discharge path of travel between the first and second limit guides to introduce a separation between the material pieces in the continuous stream preventing compression of the material upstream of the blocker member.

11. A method for introducing a separation between material pieces in a continuous stream comprising the steps of:

moving a continuous stream of material pieces in end to end relationship with respect to one another along a first path of travel at a first linear velocity;

discharging material pieces to a first discharge conveyor, the discharge conveyor having a first linear velocity substantially the same as the first linear velocity of the first path of travel;

discharging material pieces to a second discharge conveyor downstream and in communication with the stream of material pieces from the first discharge conveyor along a discharge path of travel having a first linear velocity substantially the same as the first linear velocity of the first discharge conveyor; and separating the material pieces with a dam separator on the first discharge conveyor by selectively and intermittently preventing passage of material pieces on the first discharge conveyor relative to the dam separator, the separator translating along the discharge path of travel extending and shortening the first and second discharge conveyors along the discharge path of travel to prevent compression of the material pieces upstream of the dam separator.

12. The method of claim 11 further comprising the steps of:

momentarily increasing the linear velocity of the second discharge conveyor to introduce a separation between the material pieces on the second discharge conveyor while the dam separator is preventing passage of material pieces on the first discharge conveyor;

reducing the linear velocity of the second conveyor to the first linear velocity; and releasing the dam separator allowing the material pieces to pass the dam separator to the second discharge conveyor.

13. The method of claim 11 further comprising the step of:

passing the material pieces by a sensor to monitor the number of material pieces in the stream.

14. A method for introducing a separation between material pieces in a continuous stream comprising the steps of:

moving a stream of material pieces in end to end relationship with respect to one another along a first path of travel with a linear velocity;

selectively moving the material pieces along a second path of travel and a third path of travel in communication with the stream of material pieces from the first path of travel, the second path of travel having an inlet end and an outlet end defining a first length;

the third path of travel having an inlet end and an outlet end defining a second length, the second and third paths of travel diverging proximate to the inlet ends and converging proximate to the outlet ends; and selectively diverting material pieces in the stream on the first path of travel to the second and third paths of travel providing separation between material pieces such that the material pieces on the third path of travel are selectively placed in overlapping relation to the material pieces on the second path of travel proximate the outlet ends of the second and third paths of travel.

15. The method of claim 14 wherein the second length of the third path of travel is longer than the first length of the second path of travel.

16. The method of claim 15 wherein the second length is at least one pitch longer than the first length.

17. The method of claim 14 further comprising the step of:

momentarily increasing the linear velocity of the stream of material pieces along the first path of travel to introduce a separation between the material pieces in the stream prior to reaching the inlet ends of the second and third paths of travel; and thereafter decreasing the linear velocity to the first linear velocity.

18. The method of claim 17 further comprising the step of:

decreasing the linear velocity of the stream of material pieces along the fourth path of travel.

19. The method of claim 14 further comprising the step of moving the stream of material pieces along a fourth path of travel in communication with the stream of material pieces from the second and third paths of travel proximate the outlet ends.

20. An apparatus for introducing a separation between material pieces in a continuous stream comprising:

means for moving a continuous stream of material pieces in end to end relationship with respect to one another along a first path of travel at a first linear velocity;

means for discharging material pieces to a first discharge conveyor, the discharge conveyor having a first linear velocity substantially the same as the first linear velocity of the first path of travel;

means for discharging material pieces to a second discharge conveyor downstream and in communication with the stream of material pieces from the first discharge conveyor along a discharge path of travel having a first linear velocity substantially the same as the first linear velocity of the first discharge conveyor; and means for separating the material pieces with a dam separator on the first discharge conveyor by selectively and intermittently preventing passage of material pieces on the first discharge conveyor relative to the dam separator, the separator translating along the discharge path of travel extending and shortening the first and second discharge conveyors along the discharge path of travel to prevent compression of the material pieces upstream of the dam separator.

21. An apparatus for introducing a separation between material pieces in a continuous stream comprising:

means for moving a stream of material pieces in end to end relationship with respect to one another along a first path of travel with a linear velocity;

means for selectively moving the material pieces along a second path of travel and a third path of travel in communication with the stream of material pieces from the first path of travel, the second path of travel having an inlet end and an outlet end defining a first length, the third path of travel having an inlet end and an outlet end defining a second length, the second and third paths of travel diverging proximate to the inlet ends and converging proximate to the outlet ends; and means for selectively diverting material pieces in the stream on the first path of travel to the second and third paths of travel providing separation between material pieces such that the material pieces on the third path of travel are selectively placed in overlapping relation to the material pieces on the second path of travel proximate the outlet ends of the second and third paths of travel.

22. A method of introducing a separation between material pieces in a continuous stream comprising the steps of:

moving a continuous stream of discrete individual material pieces along a first portion of a path of travel;

operably engaging selected material pieces during transition from the first portion of the path of travel to a second portion of the path of travel; and selectively introducing a separation in the continuous material stream during transition of the material pieces from the first portion to the second portion of the path of travel.

23. A method of introducing a separation between material pieces in a continuous stream comprising the steps of:

moving a continuous stream of discrete individual material pieces along a first portion of a path of travel;

operably engaging selected material pieces during transition from the first portion of the path of travel by diverting selected material pieces to a first conveyor and a second conveyor, the first and the second conveyor are in material stream communication with the first portion of the path of travel and a second portion of the path of travel; and selectively introducing a separation in the continuous material stream during transition of the material pieces from the first portion to the second portion of the path of travel.

24. A method of introducing a separation between material pieces in a continuous stream comprising the steps of:

moving a continuous stream of discrete individual material pieces along a first portion of a path of travel;

operably engaging selected material pieces during transition from the first portion of the path of travel to a second portion of the path of travel; and selectively introducing a separation in the continuous material stream during transition of the material pieces from the first portion to the second portion of the path of travel by moving the selected material pieces along a first conveyor and a second conveyor, the first conveyor having an inlet end and an outlet end defining a first length and the second conveyor having an inlet end and an outlet end defining a second length, the first conveyor and the second conveyor diverging from one another proximate to the respective inlet ends and converging toward one another proximate to the respective outlet ends.

25. The method of claim 24 wherein the second length of the second conveyor is longer than the first length of the first conveyor.

26. The method of claim 24 wherein the step of selectively introducing a separation in the continuous material stream further comprises the step of positioning the material pieces moving along the second conveyor in overlapping relation to the material pieces on the first conveyor proximate to the respective outlet ends of the first conveyor and the second conveyor thereby introducing the separation between selective material pieces in the continuous material stream.

27. An apparatus for separating materials in a continuous stream of discrete individual material pieces along a first path of travel, the apparatus comprising:

means for moving a continuous stream of discrete individual material pieces along a first portion of a path of travel, means for operably engaging selected material pieces during transition from the first portion of the path of travel to a second portion of the path of travel; and means for selectively introducing a separation in the continuous material stream during transition of the material pieces from the first portion to the second portion of the path of travel.

28. The apparatus of claim 27 wherein the means for selectively introducing a separation in the continuous material stream comprises a doubler conveyor.

29. The apparatus of claim 27 wherein the means for selectively introducing a separation in the continuous material stream comprises a dam separator.

* * * * *